US009646633B2

(12) United States Patent
Wu

(10) Patent No.: US 9,646,633 B2
(45) Date of Patent: May 9, 2017

(54) METHOD AND DEVICE FOR PROCESSING AUDIO SIGNALS

(71) Applicant: Tencent Technology (Shenzhen) Company Limited, Shenzhen (CN)

(72) Inventor: Xiaoping Wu, Shenzhen (CN)

(73) Assignee: TENCENT TECHNOLOGY (SHENZHEN) COMPANY LIMITED, Shenzhen, Guangdong Province (CN)

( * ) Notice: Subject to any disclaimer, the term of this patent is extended or adjusted under 35 U.S.C. 154(b) by 0 days.

(21) Appl. No.: 15/184,775

(22) Filed: Jun. 16, 2016

(65) Prior Publication Data

US 2016/0300585 A1 Oct. 13, 2016

Related U.S. Application Data

(63) Continuation of application No. PCT/CN2015/070234, filed on Jan. 6, 2015.

(30) Foreign Application Priority Data

Jan. 8, 2014 (CN) ..... 2014 1 0007783

(51) Int. Cl.
*G10L 21/057* (2013.01)
*G10L 21/003* (2013.01)
(Continued)

(52) U.S. Cl.
CPC ..... *G10L 21/057* (2013.01); *G10L 19/07* (2013.01); *G10L 21/003* (2013.01); *G10L 21/013* (2013.01); *G10L 25/15* (2013.01)

(58) Field of Classification Search
CPC combination set(s) only.
See application file for complete search history.

(56) References Cited

U.S. PATENT DOCUMENTS 5,822,732 A * 10/1998 Tasaki ..... G10L 19/26 704/209
6,564,184 B1 * 5/2003 Eriksson ..... H03H 17/02 704/222

(Continued)

FOREIGN PATENT DOCUMENTS

CN 1619646 A 5/2005
CN 1632863 A 6/2005

(Continued)

OTHER PUBLICATIONS

Tencent Technology, ISRWO, PCT/CN2015/070234, Apr. 14, 2015, 8 pgs.

(Continued)

*Primary Examiner* — Abul Azad
(74) *Attorney, Agent, or Firm* — Morgan, Lewis & Bockius LLP

(57) ABSTRACT

Method and device of processing audio signals are disclosed. The method includes: obtaining a set of data, the set of data comprising LSP parameters for an audio signal; determining a set of sampling data points from the set of LSP parameters using a predetermined sampling rule, the set of sampling data points including spectrum amplitude values for a plurality of sampled frequency values; identifying one or more local maxima among the set of sampling data points, and a respective preceding local minimum and a respective succeeding local minimum for each of the identified local maxima; for each of the identified local maxima, shifting one or more of the set of data comprising LSP parameters located between the respective preceding local minimum and the respective succeeding local minimum of an identified local maximum towards the identified local maximum; and adjusting the set of data comprising LSP parameters using an energy coefficient.

18 Claims, 4 Drawing Sheets

(51) Int. Cl.

| | |
|---|---|
| ***G10L 25/15*** | (2013.01) |
| ***G10L 19/07*** | (2013.01) |
| ***G10L 21/013*** | (2013.01) |

(56) References Cited

U.S. PATENT DOCUMENTS

| | | | | |
|---|---|---|---|---|
| 6,665,638 | B1 * | 12/2003 | Kang | G10L 19/04 704/219 |
| 7,065,485 | B1 * | 6/2006 | Chong-White | G10L 21/0364 704/200.1 |
| 2004/0042622 | A1 | 3/2004 | Saito | |
| 2005/0165608 | A1 * | 7/2005 | Suzuki | G10L 21/0364 704/261 |
| 2006/0149532 | A1 * | 7/2006 | Boillot | G10L 19/26 704/203 |
| 2008/0195381 | A1 | 8/2008 | Soong et al. | |
| 2012/0265534 | A1 * | 10/2012 | Coorman | G10L 13/033 704/265 |
| 2013/0030800 | A1 | 1/2013 | Tracey et al. | |

FOREIGN PATENT DOCUMENTS

| | | | |
|---|---|---|---|
| CN | 1815552 | A | 8/2006 |
| CN | 101211561 | A | 7/2008 |
| CN | 101409075 | A | 4/2009 |
| CN | 101527141 | A | 9/2009 |
| CN | 104143337 | A | 11/2014 |
| EP | 1688920 | A1 | 8/2006 |
| EP | 1727130 | A2 | 11/2006 |

OTHER PUBLICATIONS

Tencent Technology, IPRP, PCT/CN2015/070234, Jul. 12, 2016, 6 pgs.

* cited by examiner

METHOD AND DEVICE FOR PROCESSING AUDIO SIGNALS

PRIORITY CLAIM AND RELATED APPLICATION

This application is a continuation application of PCT Patent Application No. PCT/CN2015/070234, entitled "METHOD AND DEVICE FOR PROCESSING AUDIO SIGNALS" filed on Jan. 6, 2015, which claims priority to Chinese Patent Application No. 201410007783.6, entitled "METHOD AND APPARATUS FOR IMPROVING AUDIO SIGNAL QUALITY" filed on Jan. 8, 2014, both of which are incorporated by reference in their entirety.

TECHNICAL FIELD

The present application relates to the field of audio signal processing, and in particular, to a method and a device for processing audio signals and improving audio quality.

BACKGROUND

Line Spectrum Pairs (LSP) parameters, also referred to as Line Spectral Frequencies (LSF) parameters, are used to characterize audio signals. Generally, a frame of audio signals may be described with a group of LSP parameters. Each group of the LSP parameters includes multiple pieces of data that are between 0 and $\pi$ (the ratio of the circumference of a circle to its diameter). The number of pieces of data included in the group of LSP parameters is referred to as an order of the LSP parameters. To process the audio data using the LSP parameters, usually, the LSP parameters are first converted to Linear Prediction Coefficients (LPC) parameters, and then the LPC parameters are converted to audio signals using an LPC synthesizer.

In order to improve the tone of the audio signals, the peaks of the spectrum (formants) are enhanced, for example using the following two methods. A first method is an empirical formula adjustment based on LSP parameters. A second method is an adjustment based on LPC parameters, where the LSP parameters are converted to the LPC parameters and a post-filter is constructed by adjusting the LPC parameters, so as to enhance the formants. However, the foregoing methods have the following defects. Defects of the first method include that the formants are not sufficiently enhanced, which cannot effectively improve the tone. Defect of the second method is that frequency tilt is easily caused, an adjustment cannot be made based on a frequency band, and a large workload on the computations is required for this method. Therefore, it is desirable to have more efficient method and device for the audio signal processing.

SUMMARY

The embodiments of the present disclosure provide methods and devices for processing audio signals.

In accordance with some implementations of the present application, a method for processing audio signals is performed at a device having one or more processors and memory storing instructions for execution by the one or more processors. The method includes: obtaining a set of data, the set of data comprising LSP parameters for an audio signal; determining a set of sampling data points from the set of LSP parameters using a predetermined sampling rule, the set of sampling data points including spectrum amplitude values for a plurality of sampled frequency values; identifying one or more local maxima among the set of sampling data points, and a respective preceding local minimum and a respective succeeding local minimum for each of the identified local maxima; for each of the identified local maxima, shifting one or more of the set of data comprising LSP parameters located between the respective preceding local minimum and the respective succeeding local minimum of an identified local maximum towards the identified local maximum; and adjusting the set of data comprising LSP parameters using an energy coefficient after the shifting for all of the identified local maxima is completed.

In another aspect, a device comprises one or more processors, memory, and one or more program modules stored in the memory and configured for execution by the one or more processors. The one or more program modules include instructions for performing the method described above. In another aspect, a non-transitory computer readable storage medium having stored thereon instructions, which, when executed by a device, cause the device to perform the method described herein.

Various advantages of the present application are apparent in light of the descriptions below.

BRIEF DESCRIPTION OF THE DRAWINGS

The aforementioned features and advantages of the application as well as additional features and advantages thereof will be more clearly understood hereinafter as a result of a detailed description of preferred embodiments when taken in conjunction with the drawings.

To illustrate the technical solutions according to the embodiments of the present application more clearly, the accompanying drawings for describing the embodiments are introduced briefly in the following. The accompanying drawings in the following description are only some embodiments of the present application; persons skilled in the art may obtain other drawings according to the accompanying drawings without paying any creative effort.

Like reference numerals refer to corresponding parts throughout the several views of the drawings.

DESCRIPTION OF EMBODIMENTS

Figure 1:
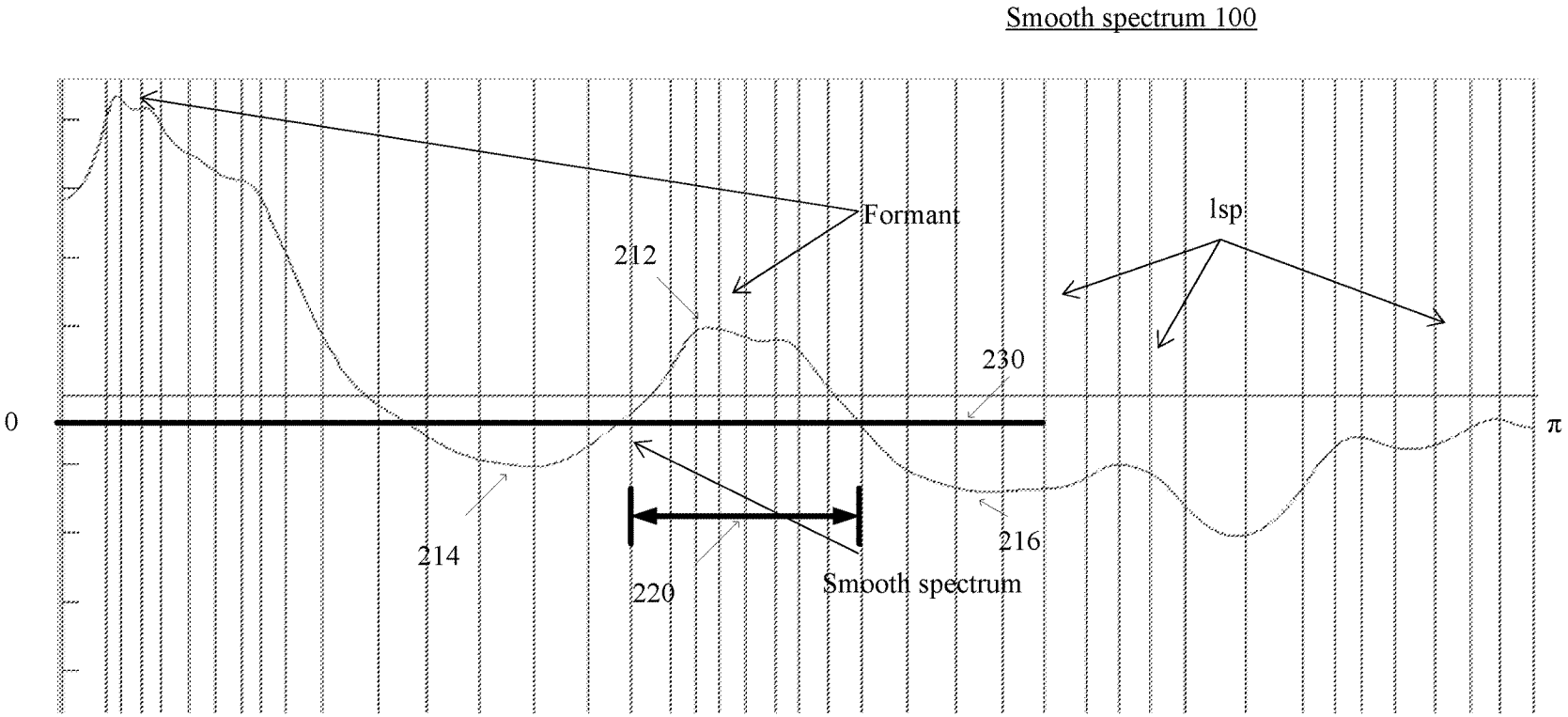
FIG. 1 is a schematic diagram of a smooth spectrum in accordance with some embodiments of the present application.

Reference will now be made in detail to embodiments, examples of which are illustrated in the accompanying drawings. In the following detailed description, numerous specific details are set forth in order to provide a thorough understanding of the subject matter presented herein. But it will be apparent to one skilled in the art that the subject matter may be practiced without these specific details. In other instances, well-known methods, procedures, components, and circuits have not been described in detail so as not to unnecessarily obscure aspects of the embodiments.

The following clearly and completely describes the technical solutions in the embodiments of the present application with reference to the accompanying drawings in the embodiments of the present application. Apparently, the described embodiments are merely a part rather than all of the embodiments of the present application. All other embodiments obtained by persons of ordinary skill in the art based on the embodiments of the present application without creative efforts shall fall within the protection scope of the present application.

Audio signals can be described by a smooth spectrum, and each frame of the audio signals corresponds to a smooth spectrum. After acquiring the data including the LSP parameters for the audio signals, in order to form the smooth spectrum by calculation, sampled frequency values are first determined on a frequency axis (in a range of 0-π) from the LSP parameters. Then a spectrum amplitude value of each respective sampled frequency value is calculated using the LSP parameters to determine the sampling data points each including a sampled frequency values and a respective spectrum amplitude value. Finally, a smooth spectrum is formed by connecting the sampling data points. Accuracy of the smooth spectrum is affected by the number of the sampling data points, and the more densely the sampling is conducted, the more accurate the smooth spectrum is. In an actual application, sampled frequency values of different densities are selected as required, to calculate the respective spectrum amplitude value of each sampled frequency value. It is noted that both terms of LSP parameters and LSF parameters are used the following one or more embodiments, and they are referring to the same concept and thus are interchangeable in the disclosed one or more embodiments.

A formula for calculating a spectrum amplitude value of the corresponding sampled frequency value is as follows:

$$d(\omega)=-10\lg|A(\omega)|^2 \quad (1), \text{ where,}$$

$$|A(\omega)|^2=[|P(\omega)|^2+|Q(\omega)|^2]/4 \quad (2),$$

where, when an order of the LSP parameters is an even number:

$$|P(\omega)|^2 = 2^{p+1}[1+\cos(\omega)]\left\{\prod_{i=1}^{p/2}[\cos(\omega)-\cos(\omega_i)]\right\}^2;$$

$$|Q(\omega)|^2 = 2^{p+1}[1-\cos(\omega)]\left\{\prod_{i=1}^{p/2}[\cos(\omega)-\cos(\theta_i)]\right\}^2$$

when the order of the LSP parameters is an odd number:

$$|P(\omega)|^2 = 2^{p+1}\left\{\prod_{i=1}^{(p+1)/2}[\cos(\omega)-\cos(\omega_i)]\right\}^2,$$

where p is an order of the LSP parameters;

$\omega_i$ and $\theta_i$ form a set of LSF parameters, where $0<\omega_1<\theta_1<\omega_2<\theta_2<\ldots<\pi$;

ω is a sampled frequency value for calculating the spectrum amplitude value;

d(ω) is a smooth spectrum value corresponding to ω;

|A(ω)| is an amplitude spectrum value of an inverse filter;

1/|A(ω)| is an amplitude spectrum value (hereinafter abbreviated as an amplitude frequency value) of the sampled frequency value; and $1/|A(\omega)|^2$ is a squared value of the amplitude spectrum value (hereinafter abbreviated as an spectrum amplitude squared value) of the sampling frequency value.

It can be seen from the formula (1) that the change of the smooth spectrum value is the same as the change of the spectrum amplitude squared value. That is, in a smooth spectrum, a sampling data point having a greater smooth spectrum value also has a greater spectrum amplitude squared value, and vice versa. In the present application, the spectrum amplitude squared value is referred to as a spectrum amplitude value used for determining a sampling data point with a respective sampled frequency value on the smooth spectrum.

FIG. 1 is a schematic diagram of a smooth spectrum 100. In FIG. 1, the horizontal axis shows frequencies with a range of (0–π), and the longitudinal axis shows the respective spectrum amplitude values. In the smooth spectrum, convex peaks are formants. The formant, a certain area in a sound spectrum where energy is concentrated, is a determinant of the tone, and reflects physical characteristics of a sound channel (a resonant cavity). When passing through the resonant cavity, the sound is filtered by the cavity, so that energy of different frequencies in a frequency domain is redistributed. Because of resonance of the resonant cavity, a part of the frequencies are enhanced, while another part of the frequencies are attenuated. The frequencies that are enhanced are shown as a dense black streak in a time-frequency analysis sonogram. Since energy is distributed unevenly, the area with energy concentration is like a peak, so it is called "formant". The formants in the smooth spectrum 100 correspond to the one or more maxima among the sampling data points. In phonetics, the formant determines the tone of vowels; while in computer sound, the formant is an important parameter that determines timbre and tone. If the formant is excessively smooth, the sound is dull. Formants of different vowels or instruments correspond to different frequency values.

It can be seen from the foregoing characteristics of the formant that the tone of an audio signal can be improved by enhancing the formants (also referred to as formant sharpening) to concentrate more energy in the formants and by improving energy contrast between the formants and other parts of the spectrum.

Figure 2:
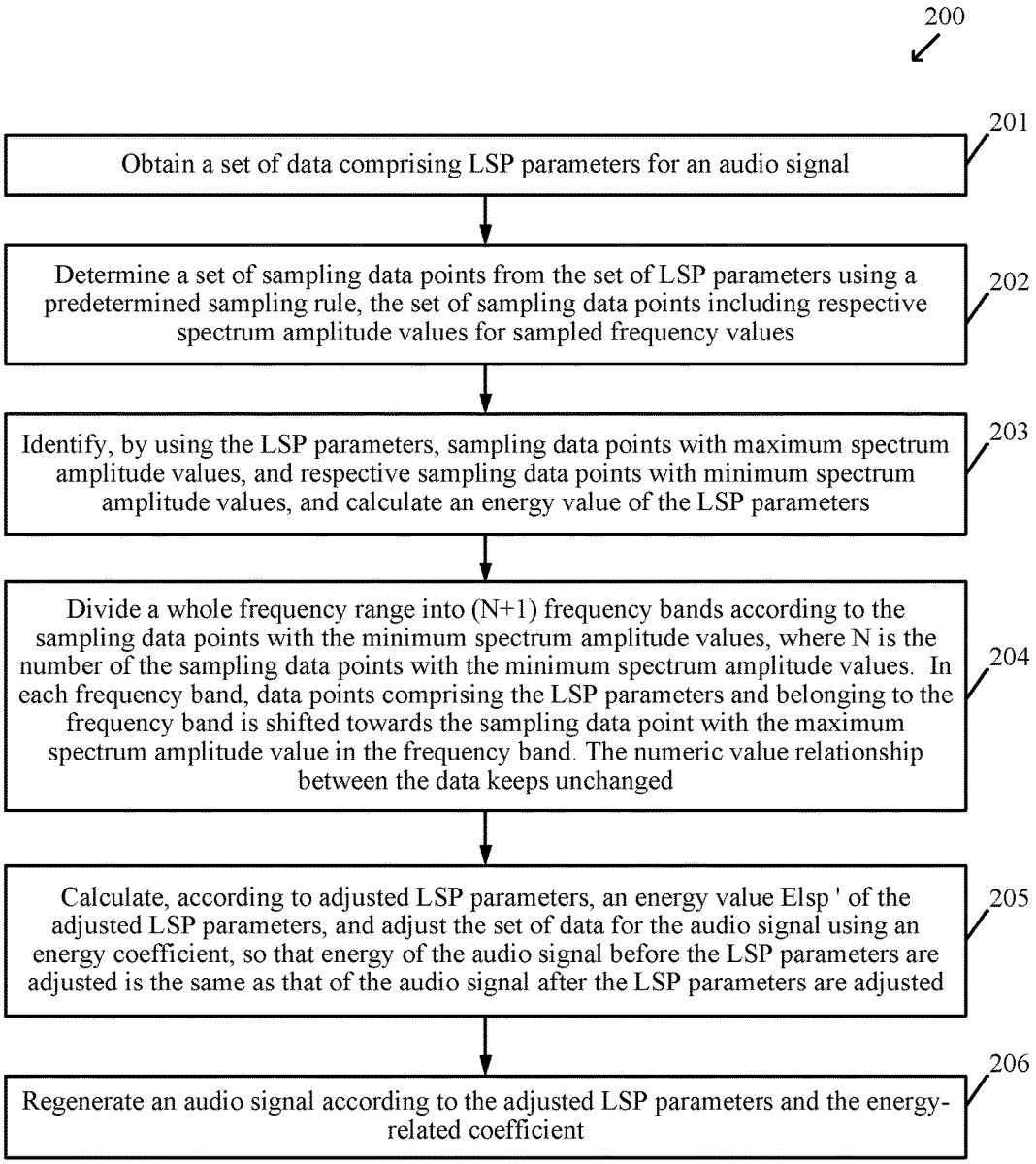
FIG. 2 is a flowchart of a method for processing audio signals in accordance with some embodiments of the present application.

FIG. 2 is a flowchart of the method 200 for processing audio signals. In some embodiments, method 200 is performed by a device (e.g., device 400, FIG. 4) including one or more processors and memory. Details of the device will be discussed later in the present application with regard to FIG. 4.

In some embodiments, the device obtains (201) a set of data comprising LSP parameters for an audio signal. The set of data may be synthesized directly, or may originate at a transducer such as a microphone, musical instrument pickup, phonograph cartridge, or tape head and converted into audio signals. The LSP parameters are related to frequencies of audio signal and valued between 0 and π. The audio signals may also include data related to both voiced sounds and unvoiced sounds. In some embodiments, prior to further sampling and processing the audio signals, the audio signals are filtered to remove the data related to the unvoiced sounds. Because the voiced sounds play a more important role in affecting the quality of the audio signals, by filtering out the unvoiced signals and focusing on processing the voiced signals, the efficiency for processing the audio signals may be improved.

The LSP parameters are usually generated by a front-end system or are converted from other parameters. The LSP parameters are accompanied by an energy coefficient and fundamental frequency information. A speech synthesis system generates the LSP parameters by using a parameter generating algorithm, and also generates an unvoiced/voiced sound identifier and an energy value coefficient. Generally, the obtained LSP parameters are excessively smooth, resulting in a dull sound. The present application does not limit the specific manner for obtaining the LSP parameters.

In one embodiment of the present application, a group of 10-order LSP parameters are obtained, including 10 pieces of data: 0.13π, 0.18π, 0.2π, 0.24π, 0.32π, 0.52π, 0.63π, 0.7π, 0.74π, and 0.85π.

In some embodiments, the device determines (202) a set of sampling data points from the set of LSP parameters using a predetermined sampling rule. The set of sampling data points include respective spectrum amplitude values (e.g., corresponding to the longitudinal axis of spectrum 100 of FIG. 1) for a plurality of sampled frequency values (e.g., corresponding to the horizontal axis of spectrum 100 of FIG. 1).

In some embodiments, the respective sampled frequency values are determined by selecting a middle value for two adjacent frequencies in the set of data. For example, the determined sampled frequency values include a middle point between 0 and a smallest piece of data in the LSP parameters, middle points between each pair of adjacent pieces of data, and a middle point between a largest piece of data in the LSP parameters and π are selected as the sampled frequency values of the sampling data points. In one embodiment of the present application, 11 sampled frequency values are selected, including: ((0+0.13π)/2=0.065π, (0.13π+0.18π)/2=0.155π, (0.18π+0.2π)/2=0.19π . . . (0.74π+0.85π)/2=0.795π, (0.85π+π)/2=0.925π.

The sampled frequency values may also be determined in other manners in the present application. For example, multiple sampled frequency values that are evenly distributed between 0 and π are selected as the sampled frequency values of the sampling data points.

In some embodiments, the device identifies (203) one or more local maxima among the set of sampling data points, and a respective preceding local minimum and a respective succeeding local minimum for each of the identified local maxim. For example, a spectrum may be plotted using the determined sampling data points (202). The device identifies the sampling data points with maximum spectrum amplitude values, and for each data point with the maximum spectrum amplitude value, a preceding sampling data point with a minimum spectrum amplitude value and a succeeding sampling data point with a minimum spectrum amplitude value are identified. In some embodiments, the device also calculates an energy value $E_{lsp}$ of the LSP parameters using the respective frequency values of the LSP parameters and the identified spectrum amplitude values.

During the identification of the sampling data points with the maximum smooth spectrum values and the respective sampling data points with the minimum spectrum amplitude values, because the change of the smooth spectrum value is the same as the change of the spectrum amplitude squared value as discussed earlier, the spectrum amplitude squared value (i.e., the spectrum amplitude value in the present application) of each sampling data point may be calculated and compared, to find sampled frequency values with maximum spectrum amplitude values (for example, a value greater than two spectrum amplitude values on two sides) and sampled frequency values with minimum spectrum amplitude values (for example, a value smaller than two spectrum amplitude values on two sides). The sampling data points with the maximum spectrum amplitude values are the sampling data points with the maximum smooth spectrum values, and the sampling data points with the minimum spectrum amplitude values are the sampling data points with the minimum smooth spectrum values. In some embodiments, the sampling data points with maximum spectrum amplitude values correspond to formants on the smooth spectrum.

In some embodiments, the foregoing formula (2) may be used to calculate the spectrum amplitude values of the sampling data points. In one embodiment, the following Table 1 includes the LSP parameters, the sampled frequency values for the sampling data points, and corresponding spectrum amplitude values $1/|A(\omega)|^2$.

TABLE 1

| | LSP parameters | | | | | | | | | | | |
|---|---|---|---|---|---|---|---|---|---|---|---|---|
| | 0 | 0.13π | 0.18π | 0.2π | 0.24π | 0.32π | 0.52π | 0.63π | 0.7π | 0.74π | 0.85π | π |
| Sampled frequency values | 0.065π | 0.155π | 0.19π | 0.22π | 0.28π | 0.42π | 0.575π | 0.665π | 0.72π | 0.795π | 0.925π | |
| $1/\|A(\omega)\|^2$ | 5.882 | 7.143 | 12.5 | 10 | 9.09 | 5.848 | 6.25 | 6.41 | 7.692 | 7.194 | 6.667 | |

According to Table 1, it is identified that the sampled frequency values with the maximum spectrum amplitude values are 0.19π with a corresponding spectrum amplitude value of 12.5, and 0.72π with a corresponding spectrum amplitude value of 7.692. The sampled frequency value of the sampling data point with the minimum spectrum amplitude value is 0.42π with a corresponding spectrum amplitude value of 5.848.

In some embodiments, a method of calculating the energy value $E_{lsp}$ of the LSP parameters is discussed as follows. An energy value in a frequency domain is equal to an integral of the square (namely, a curve of $1/|A(\omega)|^2$) of a frequency spectrum curve (namely, a curve of $1/|A(\omega)|$) from 0 to π (namely, the whole frequency range). A formula is as follows:

$$E=\int_0^{\pi} 1/|A(\omega)|^2 d\omega.$$

In a discrete system, the foregoing formula is converted to summing of results obtained by multiplying a frequency squared value (i.e. the spectrum amplitude value $1/|A(\omega)|^2$) and a sampled frequency interval, namely, $$E=\Sigma(1/|A(\omega)|^2)\cdot\Delta\omega$$

In this embodiment, the energy value $E_{lsp}$ of the LSP parameters is as follows:

$$E_{lsp}=5.882*(0.13\pi-0)+7.143*(0.18\pi-0.13\pi)+12.5*(0.2\pi-0.18\pi)+\ldots+6.667*(\pi-0.85\pi)$$

In some embodiments, for each of the identified local maxima, the device shifts (204) each of the set of data comprising the LSP parameters located between the respective preceding local minimum and the respective succeeding local minimum of an identified local maximum towards to the identified local maximum.

In some embodiments, where N is the number of the sampling data points with the sampled frequency values, the device divides a whole frequency range into (N+1) frequency bands according to the sampling data points with the minimum spectrum amplitude values. In each frequency band, data in the LSP parameters and belonging to the frequency band is shifted towards the sampling data point with the maximum spectrum amplitude value in the frequency band. In some embodiments, the numeric value relationship between the data keeps unchanged, where a first LSP parameter with a greater frequency value than a second LSP parameter remains greater after the shifting process.

The LSP parameters have properties as follows: 1. the denser the LSP parameters are, the sharper the corresponding smooth spectrum is; 2. when a value of a piece of data in the LSP parameters is changed (that is, shifting a location of a frequency value in the LSP parameters), the smooth spectrum corresponding to the changed data only differs from the original smooth spectrum within a range near the frequency value of the piece of data, while the change is substantially small in other frequency ranges.

Based on the properties of the LSP parameters as discussed above, the overall idea for sharpening the formants is as follows: adjusting the frequency values of the LSP parameters so that the frequency values of the LSP parameters at the formants are denser; and then the formants are sharper, thereby sharpening the formants.

An embodiment of the method is as follows: where N is the number of the sampling data points with the sampled frequency values, divide a whole frequency range into (N+1) frequency bands according to the sampling data points with the minimum spectrum amplitude values. In each frequency band, data in the LSP parameters and belonging to the frequency band is shifted towards the sampling data point with the maximum spectrum amplitude value in the frequency band. In some embodiments, the numeric value relationship between the data keeps unchanged, where a first LSP parameter with a greater frequency value than a second LSP parameter remains greater after the shifting process. With this shifting method, the LSP parameters near the sampling data point with the maximum spectrum amplitude value can be denser, thereby sharpening the formants.

According to the extent to which the formant actually needs to be sharpened, different shifting strategies may be adopted in different frequency bands. The present application does not limit the specific shifting strategy, as long as the shifting strategy meets the foregoing requirements.

In one embodiment of the shifting strategy, for each piece of data including LSP parameters in a frequency band, calculate a frequency difference (e.g., Δlsp, also referred to as Δlsf in the following disclosure) between two adjacent pieces of data located at one side of the sampled frequency value of the sampling data point with the maximum spectrum amplitude value, and shift the piece of data by 1/n of the frequency difference (e.g., Δlsp) towards the sampling data point with the maximum spectrum amplitude value, where n is a predetermined integer. In some embodiments, n is set to different values in different frequency bands to meet the demand of sharpening a formant in each frequency band.

The principle of shifting the LSP parameters is as follows: an original sequence of the LSP parameters is not changed, and the numeric value relationship between any two pieces of data before the shifting process is the same as that after the shifting process. Relative density between the LSP parameters is not changed. The locations of the formants are not obviously changed.

According to the sampled data points with the maximum spectrum amplitude value and the sampled data point with the minimum spectrum amplitude value that are determined above, a specific shifting manner is described in one embodiment as follows.

As identified earlier in Table 1, the sampling data point with the sampled frequency value of 0.42π has the minimum spectrum amplitude value, thus the whole frequency band is divided into two frequency bands. In the first frequency band (0~0.42π), n is equal to 4, and the sampling data point with the maximum spectrum amplitude value has the sampled frequency value of 0.19π. In the second frequency band (0.42π~π), n is equal to 6, and the sampling data point with the maximum spectrum amplitude value has the sampled frequency value of 0.72π. Therefore, LSP parameters in the first frequency band are shifted towards 0.19π, and LSP parameters in the second frequency band are moved towards 0.72π.

An embodiment of the shifting process is as follows:

a) Calculate a frequency difference between the adjacent two pieces of data:

in the first frequency band:

$$\Delta lsf1=0.18\pi-0.13\pi=0.05\pi$$

$$\Delta lsf2=0.2\pi-0.18\pi=0.02\pi$$

$$\Delta lsf3=0.24\pi-0.2\pi=0.04\pi$$

$$\Delta lsf4=0.32\pi-0.24\pi=0.08\pi$$

in the second frequency band:

$$\Delta lsf6=0.63\pi-0.52\pi=0.11\pi$$

$$\Delta lsf7=0.7\pi-0.63\pi=0.07\pi$$

$$\Delta lsf8=0.74\pi-0.7\pi=0.04\pi$$

$$\Delta lsf9=0.85\pi-0.74\pi=0.11\pi$$

b) Shifting process: In some embodiments, shifting the data towards the sampling data point with the maximum spectrum amplitude value includes increasing a respective frequency of each of the data between the maximum spectrum amplitude value and the respective preceding minimum spectrum amplitude, and decreasing a respective frequency of each of the data between the maximum spectrum amplitude value and the respective succeeding minimum spectrum amplitude. For example, b1) in the frequency band 0~0.19π, 0.13π and 0.18π in the LSP parameters are increased towards 0.19π, for example:

$$lsf1'=lsf1+\Delta lsf1/n=0.13\pi+0.05\pi/4=0.1425\pi$$

$$lsf2'=lsf2+\Delta lsf2/n=0.18\pi+0.02\pi/4=0.185\pi;$$

b2) in the frequency band 0.19π~0.42π, 0.2π, 0.24π, and 0.32π in the LSP parameters are decreased towards 0.19π, for example:

$$lsf3'=lsf3-\Delta lsf2/n=0.2\pi-0.02\pi/4=0.195\pi$$

$$lsf4'=lsf4-\Delta lsf3/n=0.24\pi-0.04\pi/4=0.23\pi$$

$$lsf5'=lsf5-\Delta lsf4/n=0.32\pi-0.08\pi/4=0.3\pi;$$

b3) in the frequency band 0.42π~0.72π, 0.52π, 0.63π, and 0.7π in the LSP parameters are increased towards 0.72π, for example:

$$lsf6'=lsf6+\Delta lsf6/n=0.52\pi+0.11\pi/6=0.538\pi$$

$$lsf7'=lsf7+\Delta lsf7/n=0.63\pi+0.07\pi/6=0.642\pi$$

$$lsf8'=lsf8+\Delta lsf8/n=0.7\pi+0.04\pi/6=0.707\pi;\text{ and}$$

b4) in the frequency band 0.72π~π, 0.74π and 0.85π in the LSP parameters are decreased towards 0.72π, for example:

$$lsf9'=lsf9-\Delta lsf8/n=0.74\pi-0.04\pi/6=0.733\pi$$

$$lsf10'=lsf10-\Delta lsf9/n=0.85\pi-0.11\pi/6=0.832\pi$$

A comparison between the LSP' parameters after the shifting process and the LSP parameters before the shifting process is shown in the following Table 2:

TABLE 2

| | | | | | | | | | | |
|---|---|---|---|---|---|---|---|---|---|---|
| LSP | 0.13π | 0.18π | 0.2π | 0.24π | 0.32π | 0.52π | 0.63π | 0.7π | 0.74π | 0.85π |
| LSP' | 0.1425π | 0.185π | 0.195π | 0.23π | 0.3π | 0.538π | 0.642π | 0.707π | 0.733π | 0.832π |

It can be seen from Table 2 that, the LSP parameters in the first frequency band are shifted towards 0.19π, and the LSP parameters in the second frequency band are shifted towards 0.72π.

In some embodiments, the LSP parameters may be processed and/or filtered before performing the shifting process. For example, the LSP parameters of one or more partial frames may be selected for the shifting process according to the actual conditions. For example, during speech synthesis, the audio tone is mainly affected by the voiced sounds. Therefore, the LSP parameters may be filtered prior to the shifting process to take out the unvoiced sounds. Then the LSP parameters for the voiced sounds are performed with the shifting process. In this way, the computation time may be shortened and the processing efficiency may be improved.

As discussed above, a respective frequency of each of the data i between the maximum spectrum amplitude value (e.g., the sampling data point with spectrum amplitude value of 12.5 in Table 1, or sampling data point 212 of FIG. 1) and the respective preceding minimum spectrum amplitude (e.g., the sampling data point with spectrum amplitude value of 5.882 in Table 1, or sampling data point 214 of FIG. 1) is increased by a value of (Δlsf−i)/n, and a respective frequency of each of the data i between the maximum spectrum amplitude value and the respective succeeding minimum spectrum amplitude (e.g., the sampling data point with spectrum amplitude value of 5.848 in Table 1, or sampling data point 216 of FIG. 1) is decreased by a value of (Δlsf−i)/n. In some embodiments, a frequency for a data point closer to the sampled data point with the maximum spectrum amplitude value is shifted by an amount greater than that of a data point farther away from the sampled data point with the maximum spectrum amplitude value.

In some embodiments, when a first maximum spectrum amplitude value is greater than a second maximum spectrum amplitude value, a greater number of sampled data points are determined for a given frequency range around the first maximum spectrum amplitude value than the second maximum spectrum amplitude value. The given frequency range may be predetermined to be a frequency range that is smaller than the respective frequency bands between the maximum spectrum amplitude values and the respective preceding or succeeding minimum spectrum amplitude values.

In some embodiments, a portion, instead of all, of the set of data comprising the LSP parameters is shifted. In some embodiments, the shifting process includes shifting solely one or more data located within a predetermined frequency range (e.g., frequency range 220 of FIG. 1) around the sampling data point with the identified maximum spectrum amplitude towards the sampling data point with the identified maximum spectrum amplitude. The predetermined frequency range is smaller than a frequency band. For example, the predetermined frequency range is smaller than the frequency range between the sampling data points with the identified maximum amplitude and the respective preceding minimum amplitude. The predetermined frequency range is also smaller than the frequency range between the sampling data points with the identified maximum amplitude and the respective succeeding minimum amplitude.

In some embodiments, the shifting process includes shifting solely one or more data located above a predetermined spectrum amplitude threshold (e.g., the amplitude threshold 230 of FIG. 1). The predetermined spectrum amplitude threshold is no greater than the identified maximum spectrum amplitude value (e.g., amplitude of data point 212 of FIG. 1), and no less than the respective preceding local minimum amplitude value (e.g., amplitude of data point 214 of FIG. 1) or the respective succeeding local minimum (e.g., amplitude data point 216 of FIG. 1).

In some embodiments, an energy value $E_{lsp'}$ of the adjusted LSP parameters is calculated (205) according to adjusted LSP parameters. An energy-related coefficient is determined and adjusted according to $E_{lsp}$ and $E_{lsp'}$ to be used for adjusting the set of data for the audio signal, so that energy of the audio signal before the LSP parameters are adjusted is the same as that of the audio signal after the LSP parameters are adjusted. Because the smooth spectrum is changed after the LSP parameters are adjusted, the energy value of the adjusted LSP parameters ($E_{lsp'}$) is also different from that before the adjustment ($E_{lsp}$). In order to keep the overall energy value of the audio signal unchanged, the energy-related coefficient of the audio signal is determined and the data are adjusted accordingly.

An energy coefficient, a fundamental frequency parameter, and the like may be adjusted. In this embodiment, the adjustment of the energy coefficient is used as an example for introduction.

An energy value may be expressed as $E=E_{lsp}\times G^2$, where

G is the energy coefficient;

$E_{lsp}$ is the energy value of the LSP parameters; and

E is the energy of the audio signal.

The energy value $E_{lsp'}$ of the adjusted LSP parameters is calculated according to the method introduced in Step 203. It can be seen from the foregoing energy expression that the energy coefficient G may be adjusted to keep E unchanged. An energy coefficient after the adjustment (G') is as follows:

$$G' = G\sqrt{\frac{E_{lsp}}{E_{lsp'}}}$$

In the foregoing process, the formants are enhanced based on the LSP parameters. Moreover, the overall energy value of the audio signal remains unchanged; therefore, an overall volume is not increased or decreased abruptly.

In some embodiments, an audio signal is regenerated (206) according to the adjusted LSP parameters and the energy-related coefficient. The present application does not limit the specific manner of generating the audio signal. During speech synthesis, the adjusted LSP parameters may be converted to LPC parameters, and the LPC parameters are delivered to an LPC synthesizer for synthesizing the audio signal.

Figure 3A:
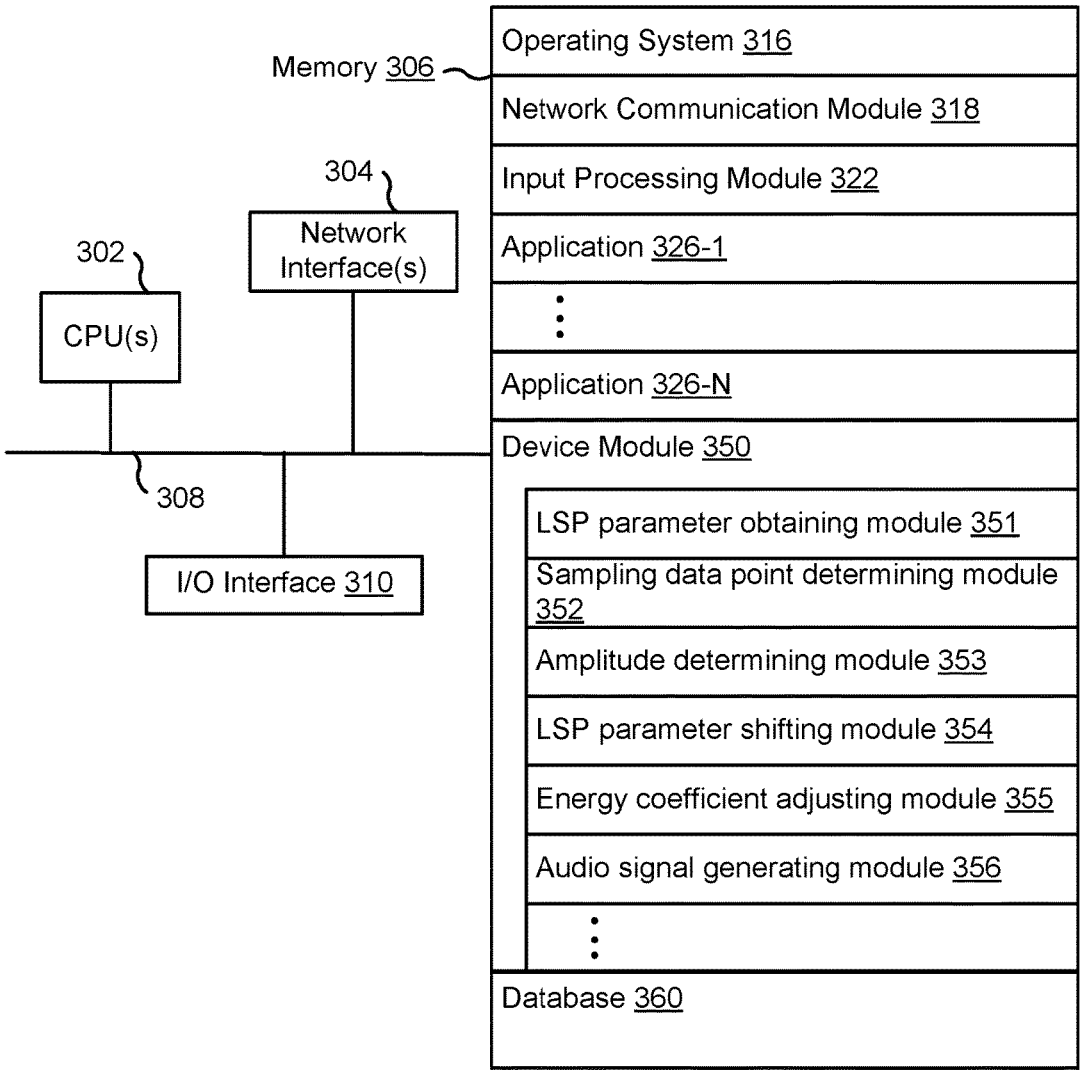
FIG. 3A is a block diagram of a device for processing audio signals in accordance with some embodiments.

FIG. 3A is a block diagram of a device 300 for processing audio signals in accordance with some embodiments. Examples of the device 300 include, but are not limited to, all types of suitable audio signal processing devices. The device 300 may further include an audio signal processing unit embedded in any suitable electronic devices, such as a handheld computer, a wearable computing device, a personal digital assistant (PDA), a tablet computer, a laptop computer, a desktop computer, a cellular telephone, a smart phone, an enhanced general packet radio service (EGPRS) mobile phone, a media player, a navigation device, a game console, a television, a remote control, or a combination of any two or more of these devices or other suitable devices.

The device 300 may include one or more processing units (CPUs) 302, one or more network interfaces 304 (wired or wireless), memory 306, and one or more communication buses 308 for interconnecting these components (sometimes called a chipset). Client device 300 also includes an input/output (I/O) interface 310. In some embodiments, the I/O interface 310 is configured to facilitate the input and output of the audio signals.

Memory 306 includes high-speed random access memory, such as DRAM, SRAM, DDR RAM, or other random access solid state memory devices; and, optionally, includes non-volatile memory, such as one or more magnetic disk storage devices, one or more optical disk storage devices, one or more flash memory devices, or one or more other non-volatile solid state storage devices. Memory 306, optionally, includes one or more storage devices remotely located from one or more processing units 302. Memory 306, or alternatively the non-volatile memory within memory 306, includes a non-transitory computer readable storage medium. In some implementations, memory 306, or the non-transitory computer readable storage medium of memory 306, stores the following programs, modules, and data structures, or a subset or superset thereof:

- operating system 316 including procedures for handling various services and for performing hardware dependent tasks;
- network communication module 318 for connecting device 300 to other computing devices (e.g., server system and/or external service(s)) connected to one or more networks via one or more network interfaces 304 (wired or wireless);
- input processing module 322 for detecting one or more audio inputs or interactions from one of the one or more input devices and interpreting the detected input or interaction;
- one or more applications 326-1-326-N for execution by the device 300; and
- device module 350, which provides audio signal processing according to various embodiments of the present application. The device module 350 is discussed in further details with regard to FIG. 3B.
- database 360 storing various data associated with processing audio signals as discussed in the present application.

Each of the above identified elements may be stored in one or more of the previously mentioned memory devices, and corresponds to a set of instructions for performing a function described above. The above identified modules or programs (i.e., sets of instructions) need not be implemented as separate software programs, procedures, modules or data structures, and thus various subsets of these modules may be combined or otherwise re-arranged in various implementations. In some implementations, memory 306, optionally, stores a subset of the modules and data structures identified above. Furthermore, memory 306, optionally, stores additional modules and data structures not described above.

Figure 3B:
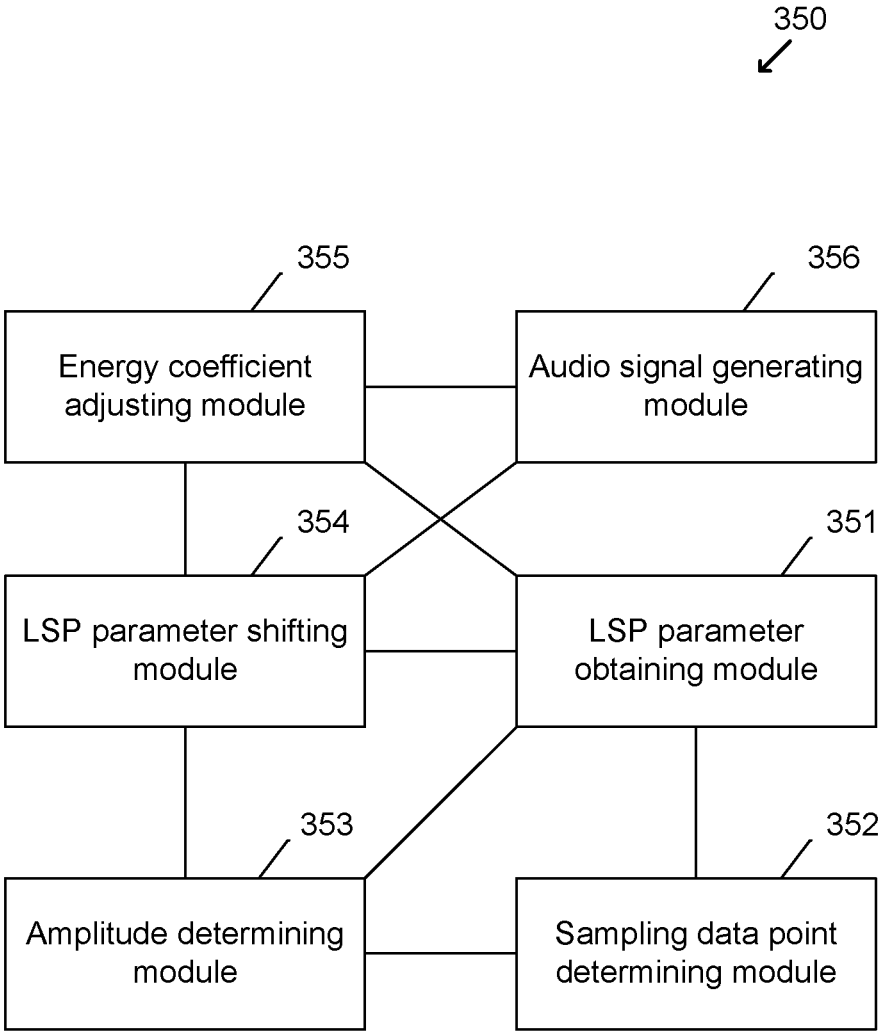
FIG. 3B is a schematic diagram of a device module included in the device of FIG. 3A in accordance with some embodiments of the present application.

FIG. 3B is a schematic diagram of the device modules 350 for processing audio signals in accordance with some embodiments of the present application. As shown in FIG. 3B, the device modules 350 includes:

- an LSP parameter obtaining module 351, configured to obtain LSP parameters;
- a sampling data point determining module 352, configured to determine a plurality of sampled frequency values of a smooth spectrum;
- an amplitude determining module 353, configured to determine, by using the LSP parameters, sampling data points (e.g., data point 212 of FIG. 1) with a maximum spectrum amplitude value, and sampling data points (e.g., data points 214 and/or 216) with minimum smooth spectrum value(s);
- an LSP parameter shifting module 354, configured to divide a whole frequency range into (N+1) frequency bands in accordance with the sampling data points with the minimum spectrum amplitude values, where N is the number of the sampling data points with the minimum spectrum amplitude value; in each frequency band, data in the LSP parameters and belonging to the frequency band is shifted towards the sampling data point with the maximum spectrum amplitude value in the frequency band, and a numeric value relationship between the data keeps unchanged;
- an energy coefficient adjusting module 355, configured to calculate an energy value Elsp of the LSP parameters according to the LSP parameters, to calculate, according to adjusted LSP parameters, an energy value Elsp' of the adjusted LSP parameters, and to adjust an energy-related coefficient of an audio signal according to Elsp and Elsp', so that energy of the audio signal before the LSP parameters are adjusted is the same as that of the audio signal after the LSP parameters are adjusted; and
- an audio signal generating module 356, configured to regenerate an audio signal according to the adjusted LSP parameters and the energy-related coefficient.

In device 300, the plurality of sampling data points determined by the sampling data point determining module 352 may be: middle points between 0 and a smallest piece of data in the LSP parameters, middle points between each pair of neighboring pieces of data in the LSP parameters, and middle points between a largest piece of data in the LSP parameters and $\pi$. The plurality of sampling data points may also be determined to be evenly distributed from 0 to $\pi$.

The amplitude determining module 353 may be configured to calculate an spectrum amplitude value of each sampling data point according to the LSP parameters, and determine sampling data points with maximum spectrum amplitude values and sampling frequency points with minimum spectrum amplitude values.

A method of the LSP parameter shifting module 354 shifting the data in the LSP parameters and belonging to the frequency band towards the sampling data point with the maximum spectrum amplitude value in the frequency band may be: for each piece of data, calculating a frequency difference between the piece of data and a neighboring piece of data at one side of the sampling data point with the maximum spectrum amplitude value; and shifting the piece of data by 1/n of the frequency difference towards the side of the sampling data point with the maximum spectrum amplitude value, where n is an integer number of the LSP parameters included in the respective frequency bands.

In the device 300, the energy-related coefficient of the audio signal may be an energy coefficient, a fundamental frequency parameter, or the like. The energy coefficient adjusting module 355 may adjust the energy coefficient according to $E_{lsp}$ and $E_{lsp'}$ by using the following formula:

$$G' = G\sqrt{\frac{E_{lsp}}{E_{lsp'}}},$$

where G' is an energy coefficient after the adjustment, and G is an energy coefficient before the adjustment.

In a word, in the method and device for processing the audio signal provided in the present application, formant points (namely, sampling data points with a maximum spectrum amplitude value) in a smooth spectrum and sampling data points with a minimum spectrum amplitude value are determined according to LSP parameters; a whole frequency range is divided into multiple frequency bands according to the sampling data points with the minimum spectrum amplitude value. LSP parameters in each frequency band are moved towards a formant in the frequency band, thereby sharpening the formants. Moreover, different sharpening extents are achieved in different frequency bands, thereby improving the tone of an audio signal.

While particular embodiments are described above, it will be understood it is not intended to limit the application to these particular embodiments. On the contrary, the application includes alternatives, modifications and equivalents that are within the spirit and scope of the appended claims. Numerous specific details are set forth in order to provide a thorough understanding of the subject matter presented herein. But it will be apparent to one of ordinary skill in the art that the subject matter may be practiced without these specific details. In other instances, well-known methods, procedures, components, and circuits have not been described in detail so as not to unnecessarily obscure aspects of the embodiments.

The terminology used in the description of the application herein is for the purpose of describing particular embodiments only and is not intended to be limiting of the application. As used in the description of the application and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, operations, elements, and/or components, but do not preclude the presence or addition of one or more other features, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

Although some of the various drawings illustrate a number of logical stages in a particular order, stages that are not order dependent may be reordered and other stages may be combined or broken out. While some reordering or other groupings are specifically mentioned, others will be obvious to those of ordinary skill in the art and so do not present an exhaustive list of alternatives. Moreover, it should be recognized that the stages could be implemented in hardware, firmware, software or any combination thereof.

The foregoing description, for purpose of explanation, has been described with reference to specific embodiments. However, the illustrative discussions above are not intended to be exhaustive or to limit the application to the precise forms disclosed. Many modifications and variations are possible in view of the above teachings. The embodiments were chosen and described in order to best explain the principles of the application and its practical applications, to thereby enable others skilled in the art to best utilize the application and various embodiments with various modifications as are suited to the particular use contemplated.

What is claimed is:

1. A method of improving the tone of an audio signal, which is performed at an electronic device having one or more processors and memory, the method comprising:

obtaining a set of data, the set of data comprising Linear Spectrum Pairs (LSP) parameters for the audio signal;

determining a set of sampling data points from the set of data comprising the LSP parameters using a predetermined sampling rule, the set of sampling data points including respective spectrum amplitude values for a plurality of sampled frequency values;

identifying one or more local maxima among the set of sampling data points, and a respective preceding local minimum and a respective succeeding local minimum for each of the identified local maxima;

for each of the identified local maxima, shifting one or more of the set of data comprising the LSP parameters located between the respective preceding local minimum and the respective succeeding local minimum of the identified local maximum towards the identified local maximum, wherein shifting the one or more of the set of data further comprises shifting solely data located within a predetermined frequency range around the identified local maximum towards the identified local maximum, and the predetermined frequency range is smaller than any of a frequency range between the identified local maximum and the respective preceding local minimum, and a frequency range between the identified local maximum and the respective succeeding local minimum; and adjusting the set of data comprising the LSP parameters using an energy coefficient after the shifting for all of the identified local maxima is completed.

2. The method of claim 1, wherein determining the set of sampling data points from the set of data comprising the LSP parameters using the predetermined sampling rule comprises:

determining a respective sampled frequency value of the set of sampling data points by selecting a middle value for two adjacent frequencies in the set of data.

3. The method of claim 1, wherein the sampled frequency values of the set of sampling data points are determined to be evenly distributed between 0 and $\pi$.

4. The method of claim 1, wherein when a first local maximum has a higher spectrum amplitude value than a second local maximum among the identified local maxima, a greater number of sampled data points are determined for a given frequency range around the first local maximum than the second local maximum.

5. The method of claim 1, wherein for each of the identified local maxima, shifting the one or more of the set of the data comprises:

increasing respective frequencies of one or more of the set of the data located between the identified local maximum and the respective preceding local minimum thereof; and decreasing respective frequencies of one or more of the set of the data located between the identified local maximum and the respective succeeding local minimum thereof.

6. The method of claim 5, wherein increasing the respective frequencies of the one or more of the set of data between the identified local maximum and the respective preceding local minimum thereof further comprises:

increasing the respective frequency for a first data point closer to the identified local maximum by an amount more than a second data point farther away from the identified local maximum.

7. The method of claim 1, wherein shifting the one or more of the set of data comprises:

shifting solely data located above a predetermined spectrum amplitude threshold, and wherein the predetermined spectrum amplitude threshold is no greater than the identified maximum spectrum amplitude value, and no less than the respective preceding local minimum or the respective succeeding local minimum.

8. The method of claim 1, further comprising:

filtering the audio signal so that the set of data comprising the LSP parameters are related to voiced audio signal.

9. An electronic device for improving the tone of an audio signal, comprising:

one or more processors; and memory storing one or more programs to be executed by the one or more processors, the one or more programs comprising instructions for:

obtaining a set of data, the set of data comprising Linear Spectrum Pairs (LSP) for the audio signal;

determining a set of sampling data points from the set of data comprising the LSP parameters using a predetermined sampling rule, the set of sampling data points including respective spectrum amplitude values for a plurality of sampled frequency values;

identifying one or more local maxima among the set of sampling data points, and a respective preceding local minimum and a respective succeeding local minimum for each of the identified local maxima;

for each of the identified local maxima, shifting one or more of the set of data comprising the LSP parameters located between the respective preceding local minimum and the respective succeeding local minimum of the identified local maximum towards the identified local maximum, wherein shifting the one or more of the set of data further comprises shifting solely data located within a predetermined frequency range around the identified local maximum towards the identified local maximum, and the predetermined frequency range is smaller than any of a frequency range between the identified local maximum and the respective preceding local minimum, and a frequency range between the identified local maximum and the respective succeeding local minimum; and adjusting the set of data comprising the LSP parameters using an energy coefficient after the shifting for all of the identified local maxima is completed.

10. The electronic device of claim 9, wherein determining the set of sampling data points from the set of data comprising the LSP parameters using the predetermined sampling rule comprises:

determining a respective sampled frequency value of the set of sampling data points by selecting a middle value for two adjacent frequencies in the set of data.

11. The electronic device of claim 9, wherein for each of the identified local maxima, shifting the one or more of the set of the data comprises:

increasing respective frequencies of one or more of the set of the data located between the identified local maximum and the respective preceding local minimum thereof; and decreasing respective frequencies of one or more of the set of the data located between the identified local maximum and the respective succeeding local minimum thereof.

12. The electronic device of claim 9, wherein shifting the one or more of the set of data comprises:

shifting solely data located above a predetermined spectrum amplitude threshold, and wherein the predetermined spectrum amplitude threshold is no greater than the identified maximum spectrum amplitude value, and no less than the respective preceding local minimum or the respective succeeding local minimum.

13. The electronic device of claim 9, further comprising:

filtering the audio signal so that the set of data comprising the LSP parameters are related to voiced audio signal.

14. A non-transitory computer readable storage medium storing one or more programs, the one or more programs comprising instructions, which, when executed by an electronic device with one or more processors and a display for improving the tone of an audio signal, cause the device to perform operations comprising:

obtaining a set of data, the set of data comprising Linear Spectrum Pairs (LSP) parameters for the audio signal;

determining a set of sampling data points from the set of data comprising the LSP parameters using a predetermined sampling rule, the set of sampling data points including respective spectrum amplitude values for a plurality of sampled frequency values;

identifying one or more local maxima among the set of sampling data points, and a respective preceding local minimum and a respective succeeding local minimum for each of the identified local maxima;

for each of the identified local maxima, shifting one or more of the set of data comprising the LSP parameters located between the respective preceding local minimum and the respective succeeding local minimum of the identified local maximum towards the identified local maximum, wherein shifting the one or more of the set of data further comprises shifting solely data located within a predetermined frequency range around the identified local maximum towards the identified local maximum, and the predetermined frequency range is smaller than any of a frequency range between the identified local maximum and the respective preceding local minimum, and a frequency range between the identified local maximum and the respective succeeding local minimum; and adjusting the set of data comprising the LSP parameters using an energy coefficient after the shifting for all of the identified local maxima is completed.

15. The non-transitory computer readable storage medium of claim 14, wherein determining the set of sampling data points from the set of data comprising the LSP parameters using the predetermined sampling rule comprises:

determining a respective sampled frequency value of the set of sampling data points by selecting a middle value for two adjacent frequencies in the set of data.

16. The non-transitory computer readable storage medium of claim 14, wherein for each of the identified local maxima, shifting the one or more of the set of the data comprises:

increasing respective frequencies of one or more of the set of the data located between the identified local maximum and the respective preceding local minimum thereof; and decreasing respective frequencies of one or more of the set of the data located between the identified local maximum and the respective succeeding local minimum thereof.

17. The non-transitory computer readable storage medium of claim 14, wherein shifting the one or more of the set of data comprises:

shifting solely data located above a predetermined spectrum amplitude threshold, and wherein the predetermined spectrum amplitude threshold is no greater than the identified maximum spectrum amplitude value, and no less than the respective preceding local minimum or the respective succeeding local minimum.

18. The non-transitory computer readable storage medium of claim 14, further comprising:

filtering the audio signal so that the set of data comprising the LSP parameters are related to voiced audio signal.

* * * * *